US007501991B2

(12) United States Patent
Yeap

(10) Patent No.: US 7,501,991 B2
(45) Date of Patent: Mar. 10, 2009

(54) ASYMMETRIC DIPOLE ANTENNA

(75) Inventor: Siew Bee Yeap, Penang (MY)

(73) Assignee: Laird Technologies, Inc., Lincoln, NE (US)

( * ) Notice: Subject to any disclaimer, the term of this patent is extended or adjusted under 35 U.S.C. 154(b) by 81 days.

(21) Appl. No.: 11/676,364

(22) Filed: Feb. 19, 2007

(65) Prior Publication Data

US 2008/0198084 A1 Aug. 21, 2008

(51) Int. Cl.
*H01Q 9/28* (2006.01)

(52) U.S. Cl. ..... 343/795; 343/700 MS

(58) Field of Classification Search ..... 343/795, 343/700 MS

See application file for complete search history.

(56) References Cited

U.S. PATENT DOCUMENTS

| | | | | |
|---|---|---|---|---|
| 6,359,589 | B1 | 3/2002 | Bae | |
| 6,421,013 | B1 | 7/2002 | Chung | |
| 6,529,171 | B1 | 3/2003 | Le Balier et al. | |
| 6,567,049 | B1 | 5/2003 | Huang et al. | |
| 6,741,219 | B2 | 5/2004 | Shor | |
| 6,774,855 | B2 | 8/2004 | Bateman et al. | |
| 6,791,506 | B2 | 9/2004 | Suganthan et al. | |
| 6,847,329 | B2 | 1/2005 | Ikegaya et al. | |
| 6,864,642 | B2 | 3/2005 | Hung et al. | |
| 6,961,028 | B2 | 11/2005 | Joy et al. | |
| 7,027,005 | B1 | 4/2006 | Chien | |
| 7,042,415 | B2 * | 5/2006 | Cheng | 343/795 |
| 7,129,904 | B2 * | 10/2006 | Chen | 343/795 |
| 7,151,500 | B2 * | 12/2006 | Su et al. | 343/795 |
| 2003/0231138 | A1 | 12/2003 | Weinstein | |
| 2003/0231139 | A1 | 12/2003 | Tai et al. | |
| 2004/0183728 | A1 | 9/2004 | Zinanti et al. | |
| 2004/0196191 | A1 | 10/2004 | Hung et al. | |
| 2004/0222936 | A1 * | 11/2004 | Hung et al. | 343/795 |
| 2004/0263391 | A1 | 12/2004 | He et al. | |
| 2005/0035919 | A1 * | 2/2005 | Yang et al. | 343/795 |
| 2006/0033666 | A1 | 2/2006 | Su et al. | |
| 2006/0055615 | A1 | 3/2006 | Zhou | |
| 2006/0061514 | A1 | 3/2006 | Chien | |

FOREIGN PATENT DOCUMENTS

| | | |
|---|---|---|
| EP | 1 414 109 A2 | 10/2003 |
| JP | 2002280817 A | 9/2002 |
| TW | 519309 | 1/2003 |

* cited by examiner

*Primary Examiner*—Hoang V Nguyen
(74) *Attorney, Agent, or Firm*—Holland & Hart LLP

(57) ABSTRACT

A multiple frequency dipole antenna is provided. The antenna includes a plurality of conductive traces on a substrate (flexible or rigid). One conductive trace comprises the radiating portion and includes a plurality of radiating arms asymmetrically arranged. The other conductive trace comprises the ground portion and includes a plurality of ground arms. Radio frequency power is supply using, for example, a coaxial cable feed. The outer conductor of the coaxial cable feed is attached ground portion (either substantially parallel or perpendicular to a portion of the ground arms. The central conductor of the cable traverses a gap between the radiating portion and ground portion and is coupled to the radiating portion distal from the radiating arms.

15 Claims, 1 Drawing Sheet

ASYMMETRIC DIPOLE ANTENNA

RELATED PATENTS AND PATENT APPLICATION

The present Application for Patent is related to the following co-pending U.S. patent applications and issued patents:

U.S. patent application Ser. No. 11/217,760, titled Multi-band omni directional antenna, filed Sep. 1, 2005, which is a continuation of U.S. patent application Ser. No. 10/708,520, titled Multi-band omni directional antenna, filed Mar. 9, 2004, now U.S. Pat. No. 6,943,731, the disclosures of which are incorporated herein by reference as if set out in full; and U.S. Pat. No. 6,791,506, titled Dual band single feed dipole antenna and method of making the same, filed Oct. 23, 2002, the disclosure of which is incorporated herein by reference as if set out in full.

BACKGROUND

1. Field

The technology of the present application relates generally to dipole antennas, and more specifically to asymmetrical dipole antennas.

2. Background

Omni directional antennas are useful for a variety of wireless communication devices because the radiation pattern allows for good transmission and reception from a mobile unit. Currently, printed circuit board omni directional antennas are not widely used because of various drawbacks in the antenna device. In particular, cable power feeds to conventional omni directional antennas tend to alter the antenna impedance and radiation pattern, which reduces the benefits of having the omni directional antenna.

One useful antenna provides a omni direction antenna having a radiating portion and a power dissipation portion. A power source feed is coupled to the radiating portion to provide RF power to the radiating elements. A power source ground is coupled to the power dissipation portion. The power dissipation portion tends to reduce the influence the power feed has on the radiation pattern of the omni directional antenna.

Another useful antenna provides a dual band single center feed dipole antenna. The dipole is loaded by providing open circuit arms or stubs that form a second dipole that resonates at a second frequency.

Still, however, there is a need in the industry for improved compact wideband omni directional antennas.

SUMMARY

To attain the advantages and in accordance with the purpose of the invention, as embodied and broadly described herein, an omni directional antenna is provided. The antenna includes a plurality of conductive traces on a substrate (flexible or rigid). One conductive trace comprises the radiating portion and includes a plurality of radiating arms asymmetrically arranged. The other conductive trace comprises the ground portion and includes a plurality of ground arms. Radio frequency power is supply using, for example, a coaxial cable feed. The outer conductor of the coaxial cable feed is attached ground portion (either substantially parallel or perpendicular to a portion of the ground arms. The central conductor of the cable traverses a gap between the radiating portion and ground portion and is coupled to the radiating portion distal from the radiating arms.

The foregoing and other features, utilities and advantages of the invention will be apparent from the following more particular description of a preferred embodiment of the invention as illustrated in the accompanying drawings.

BRIEF DESCRIPTION OF THE DRAWINGS

The accompanying drawings, which are incorporated in and constitute a part of this specification, illustrate embodiments of the present invention, and together with the description, serve to explain the principles thereof. Like items in the drawings may be referred to using the same numerical reference.

DETAILED DESCRIPTION

The word "exemplary" is used herein to mean "serving as an example, instance, or illustration." Any embodiment described herein as "exemplary" is not necessarily to be construed as preferred or advantageous over other embodiments. Moreover, any embodiment described herein should be considered exemplary unless otherwise specifically noted. The technology of the present invention is specifically described with respect to a multiple band dipole antenna comprising two radiating arms and three ground arms. One of ordinary skill in the art will recognize on regarding the disclosure, however, other constructions and configurations are possible.

Figure 1:
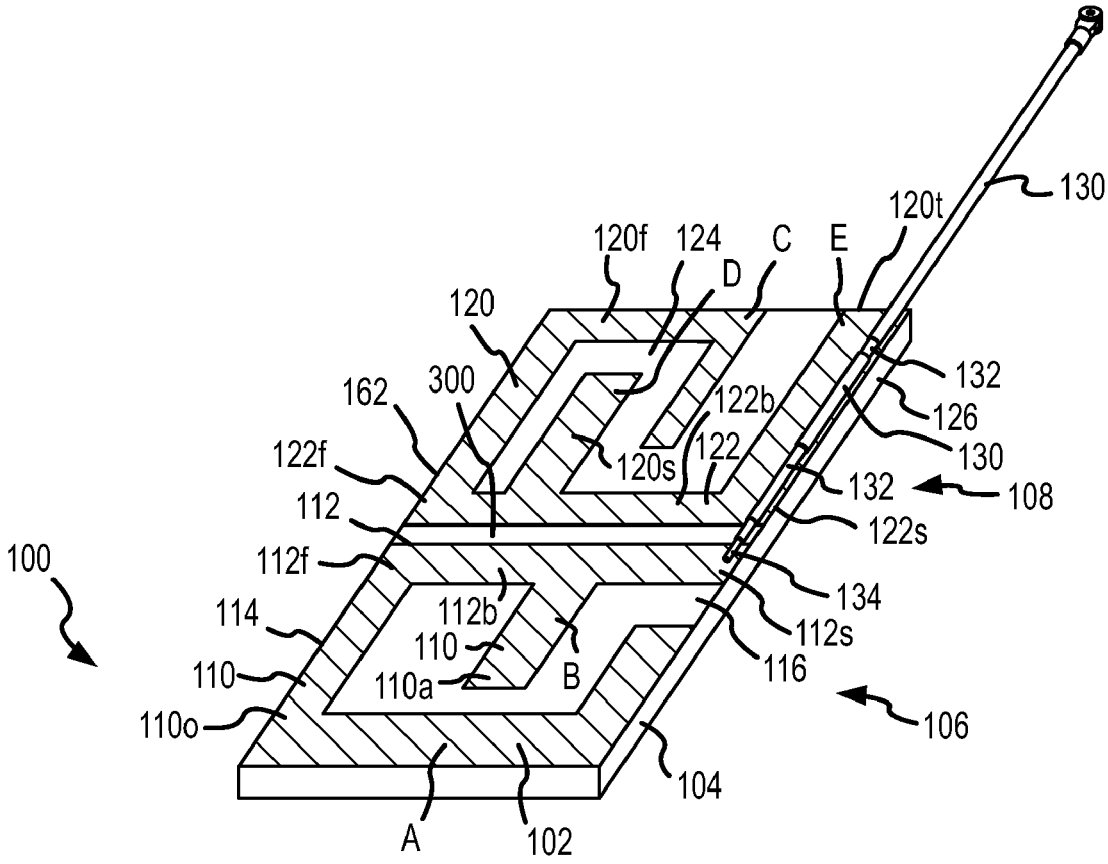
FIG. 1 is a perspective view of an antenna constructed using the technology of the present application

Referring first to FIG. 1, an antenna 100 constructed using technology of the present invention is provided. Antenna 100 is with conductive traces 102 on a substrate 104. Conductive traces 102 may be formed on substrate 104 using any conventional method, such as, for example, metal stamping, metal foils, etching, plating, or the like. Conductive traces 102 are conventional formed of copper, but other radio frequency conductive material is possible. Substrate 104 comprises printed circuit board material, FR4, or the like. Moreover, while shown as a relatively rigid substrate, substrate 104 may comprise flexible material.

Antenna 100 can be separated into a radiating portion 106 and a ground portion 108. Radiating portion 106 comprises conductive traces 102 arranged with a plurality of radiating arms 110 extending from a radiating portion base 112. Radiating portion base 112 has a first base end 112*f* and a second base end 112*s* with a base body 112*b* extending therebetween. The plurality of radiating arms 110 extend asymmetrically from radiating base 112. While placement specifically depends on a number of conventional factors, in this case, one radiating arm 110*o* extend from first base end 112*f* along a first end an edge 114 of substrate 104 forming a gap, slot, space, or recess 116 about another radiating arm 110*a*. The radiating arm 110*a* extends from base body 112*b* between the first base end 112*f* and the second base end 112*s* into gap 116. Radiating arm 110*o* has a first shape A and radiating arm 110*a* has a second shape B. First shape A and second shape B are shown as different, but could be the same.

Ground portion 108 comprises conductive traces 102 arranged with a plurality of ground arms 120. Ground portion includes a ground portion base 122 having a first ground end 122*f* and a second ground end 122*s* with a ground body 122*b* extending therebetween. While placement specifically depends on a number of conventional factors, in this case, a first ground arm 120*f* extends from the first ground end and wraps around a second ground arm 120*s* such that a gap, slot, space, or recess 124 exists. A third ground arm 120*t* extends from second ground end 122*s* along an edge 126 opposite edge 114. While shown offset, another radiating arm 110*a* and second ground arm 120*s* may be opposite each other. First ground arm 120*f* has a shape C. Second ground arm 120*s* has a shape D. Third ground arm 120*t* has a shape E. While shown as different, the shapes C, D, and E could be the same (see FIG. 2).

Radio frequency power is supply by a power feed 130. Power feed 130 is shown as a coaxial cable feed, but could be other conventional radio frequency power sources. Power feed 130 has a ground portion 132 and a conductor portion 134. Conductor portion 134 extends over gap 300 separating radiating portion 106 and ground portion 108 and is connected to radiating portion base 112 proximate second base end 112*s* to supply radio frequency power to radiating portion 106. Ground portion 132 is connected to third ground arm 120*t* along edge 126. As can be appreciated, power feed 130 extends along third ground arm 120*t*.

While other configurations are possible with more or less radiating arms and ground arms, antenna 100 provides two radiating arms and three ground arms providing antenna 100 the ability to resonate at multiple frequencies. The arrangement of the arms, including the extension of some arms into gaps provide enhanced coupling.

Third ground arm 120*t* when aligned with power feed 130 may be considered a feed arm. Ground portion 132 may be connected to third ground arm 120 using any conventional means, but for a coaxial power feed as shown a solder connection is satisfactory. When soldered, the ground portion should be soldered at least in two locations to inhibit the movement of power feed 130.

Figure 2:
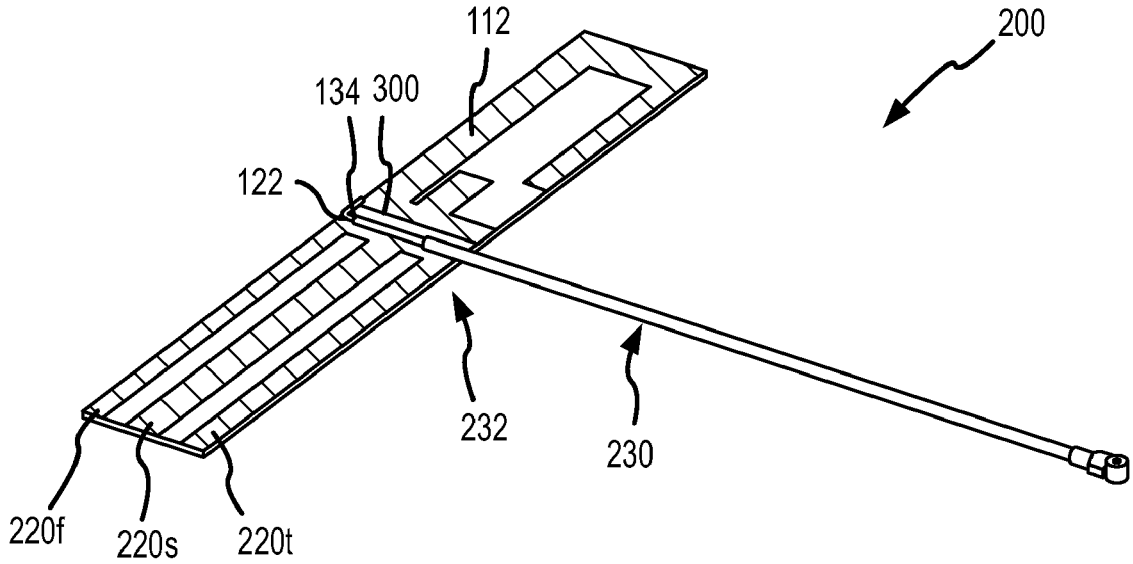
FIG. 2 is a perspective view of an antenna constructed using the technology of the present application.

Referring now to FIG. 2, an antenna 200 is shown. Antenna 200 is similar to antenna 100 and the similarities will not be re-described herein. In this case, antenna 200 ground arms 220*f*, 220*s*, and 220*t* arranged symmetrically about ground base portion 122; however, asymmetrical orientation also is possible. In this case, power feed 230 is arranged to extend substantially parallel to ground base portion 122, instead of substantially perpendicular as described with respect to antenna 100. Power feed 230 has a ground portion 232 coupled to ground base portion 122 and a conductor portion 134. Conductor portion 134 extends over a gap 300 between ground base portion 122 and radiating portion base 112 and is connected to radiating portion base 112 to provide radio frequency power.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A multiple frequency antenna, comprising:

a substrate;

a plurality of conductive traces formed on the substrate, one of the plurality of conductive traces forming a radiating portion and another of the plurality of conductive traces forming a ground portion;

the radiating portion comprising a radiating portion base having a first base end and a second base end connected by a base body and two radiating arms extending from the radiating portion base, wherein one of the two radiating arms extends from the first base end and forms a space and the other of the two radiating arms extends from the base body into the space;

the ground portion being separated from the radiating portion by a gap and comprising a ground portion base having a first ground end and a second ground end connected by a ground body and a plurality of ground arms extending from the ground portion base; and a power feed, the power feed comprising a ground portion aligned substantially parallel with at least a portion of one of the plurality of ground arms and substantially perpendicular to the radiating portion base, and a conductor portion traversing the gap and coupled to the radiating portion base, wherein the antenna operates at multiple frequencies.

2. The antenna according to claim 1, wherein one of the two of the radiating arms has a different shape than the other of the two radiating arms.

3. The antenna according to claim 1, wherein the plurality of ground arms comprises three ground arms, a first ground arm extending from a first ground end forming a space, a second ground arm extending from a ground body into the space, and a third ground arm extending from a second ground end.

4. The antenna according to claim 3, wherein the third ground arm comprises a feed arm and the power feed is substantially aligned with the feed arm.

5. The antenna according to claim 4, wherein the power feed comprising a coaxial cable such that an outer conductor of the coaxial is coupled to the feed arm and a central conductor of the coaxial cable traverses the gap and is coupled to the radiating portion base.

6. The antenna according to claim 5, wherein the central conductor is coupled proximate the second base end.

7. The antenna according to claim 1, wherein the plurality of ground arms comprises three ground arms arranged symmetrically along the ground body.

8. The antenna according to claim 1 wherein the substrate is flexible.

9. A multiple frequency antenna, comprising:

a substrate;

a plurality of conductive traces formed on the substrate, one of the plurality of conductive traces forming a radiating portion and another of the plurality of conductive traces forming a ground portion;

the radiating portion comprising a radiating portion base having a first base end and a second base end connected by a base body and two radiating arms extending from the radiating portion base, wherein one of the two radiating arms extends from the first base end and forms a space and the other of the two radiating arms extends from the base body into the space;

the ground portion being separated from the radiating portion by a gap and comprising a ground portion base having a first ground end and a second ground end connected by a ground body and a plurality of ground arms extending from the ground portion base; and a power feed, the power feed comprising a ground portion aligned substantially parallel with at least a portion of the ground base and substantially parallel to a portion of the radiating portion base, and a conductor portion traversing the gap and coupled to the radiating portion base, wherein the antenna operates at multiple frequencies.

10. The antenna according to claim 9, wherein the plurality of ground arms are symmetrically arranged along the ground portion base.

11. The antenna according to claim 10, wherein the power feed comprises a coaxial cable conductor such that an outer conductor of the coaxial cable is the ground portion and a center conductor is the conductor portion.

12. The antenna according to claim 11, wherein the center conductor connects to the radiating portion proximate the second base end.

13. A multiple frequency antenna, comprising:

a substrate;

a plurality of conductive traces formed on the substrate, one of the plurality of conductive traces forming a radiating portion and another of the plurality of conductive traces forming a ground portion;

the radiating portion comprising a radiating portion base having a first base end and a second base end connected by a base body and two radiating arms extending from the radiating portion base, wherein one of the two radiating arms extends from the first base end and forms a space and the other of the two radiating arms extends from the base body into the space;

the ground portion being separated from the radiating portion by a gap and comprising a ground portion base having a first ground end and a second ground end connected by a ground body and a plurality of ground arms extending from the ground portion base; and a power feed, the power feed comprising a ground portion and a conductor portion, the conductor portion coupled to the radiating portion proximate the second base end opposite the at least one of the plurality of radiating arms, wherein the antenna operates at multiple frequencies.

14. The antenna according to claim 13, wherein the power feed extends substantially perpendicular to the ground portion base.

15. The antenna according to claim 13, wherein the power feed extends substantially parallel to the ground portion base.

* * * * *